United States Patent [19]

Coleman

[11] 4,114,758

[45] Sep. 19, 1978

[54] PACKAGE AND METHOD OF MAKING

[75] Inventor: Eugene W. Coleman, Richmond Heights, Ohio

[73] Assignee: Picker Corporation, Cleveland, Ohio

[21] Appl. No.: 829,978

[22] Filed: Sep. 1, 1977

Related U.S. Application Data

[60] Continuation of Ser. No. 542,510, Jan. 20, 1975, which is a division of Ser. No. 331,701, Feb. 12, 1973, Pat. No. 3,861,529, which is a continuation of Ser. No. 83,891, Oct. 26, 1970, abandoned.

[51] Int. Cl.[2] ..... B65D 73/00; B65B 31/00

[52] U.S. Cl. ..... 206/471; 53/433; 206/524.8

[58] Field of Search ..... 53/22 A, 22 B; 206/471, 206/524.8

[56] References Cited

U.S. PATENT DOCUMENTS 3,216,172 11/1965 Piazze ..... 53/22 B

FOREIGN PATENT DOCUMENTS 555,219 4/1958 Canada ..... 53/22 A

*Primary Examiner*—Travis S. McGehee

*Attorney, Agent, or Firm*—Watts, Hoffmann, Fisher & Heinke Co.

[57] ABSTRACT

A skin package with a plastic base sheet and a method of making it, the base sheet has projections and recesses therebetween. A heat-softened cover sheet is forced down over a product and brought into engagement with the base sheet by establishing a pressure differential.

The base sheet is formed by establishing a pressure differential while the sheet is heat softened and on a perforated platen of a skin packaging machine. There the base sheet is inverted so that those portions of the sheet which have been drawn into the perforations provide the projections.

23 Claims, 7 Drawing Figures

PACKAGE AND METHOD OF MAKING

This is a continuation of application Ser. No. 542,510 filed Jan. 20, 1975, which is a divisional of application Ser. No. 331,701 filed Feb. 12, 1973 (now U.S. Pat. No. 3,861,529), which is a continuation of application Ser. No. 83,891 filed Oct. 26, 1970 (now abandoned) of Eugene W. Coleman for PACKAGE AND METHOD OF MAKING.

BACKGROUND OF THE INVENTION

1. Field of the Invention

This invention relates to a method of securing a body between two imperforate sheets and more particularly in its preferred form to a method of skin packaging and a skin package formed by the method.

2. Prior Art

So-called skin packages have now become well known in the art. With the typical skin package, a permeable base sheet is provided. With one form of skin packaging, a surface of the base sheet has been coated with an adhesive and the adhesive then perforated to provide a permeable layer.

This sheet is positioned over a vacuum chamber with the adhesive side up. The product to be packaged is positioned on the adhesive-treated surface. A film of thermoplastic material is then heat softened and brought down over the product and the sheet. The vacuum chamber is operated to establish a pressure differential such that the thermosoftened sheet is forced down over the product into an intimate, bonded contact with the adhesive surface of the base sheet.

In other forms of skin packaging, adhesive is not applied to the base sheet, but rather a treated film which will become adhesively secured to the base sheet is utilized. When the film is heat softened and forced into contact with the sheet through pressure differential, it bonds to the sheet around the product being packaged.

There have been proposals for providing selected imperforate areas in the base sheet. For example, when packaging a soft product, it has been proposed to provide a protective ring around the product and position the product on an imperforate area. When the plastic film is forced down against the base sheet, it adheres around the protective ring but is not drawn down into the ring and against the soft product. While there have been such proposals, formation of the package has nonetheless relied upon the permeability of the base sheet.

SUMMARY OF THE PRESENT INVENTION

The present invention is directed to a novel and improved process and package in which an imperforate plastic base sheet is used in skin packaging. The finished package is all plastic, having a number of advantages, many of which will be described.

It has been discovered that with an imperforate base sheet having projections and recesses therebetween, a skin package can be achieved with an otherwise more or less conventional process. The product is positioned on the formed sheet and a pressure differential is established. The heat softened film is brought down over the sheet. Air entrapped between the film and the sheet escapes through recesses between the projections as the established pressure differential forces the film into tight intimate contact with the substrate. It is believed that the escaping, flowing air serves to maintain the film and base sheet in spaced relationship while, at the same time, assisting in permitting the establishment of an appropriate pressure differential.

With the present invention, the base sheet is formed so that it has a series of projections and recesses therebetween. Preferably, the forming of the base sheet is achieved by thermoforming. This thermoforming of the base sheet can be accomplished with a standard skin packaging machine set up in a manner akin to the manner utilized when blister packages are formed. Specifically, a mold may be formed with air holes drilled through it. A plastic sheet is placed over the mold and heat softened. A pressure differential is then established to draw the plastic sheet against the mold and to cause it to achieve the contour of the mold.

In its simplest and preferred form, a "dimpled" base sheet is formed by placing a plastic film on the platen of a skin packaging machine. The film is heat softened and vacuum is applied so that the platen itself serves as the mold. After formation, the base sheet is inverted and used as a base sheet for forming a skin package.

In addition to the many characteristics which make the packages made in accordance with this invention superior packages for many applications, there are considerable economic advantages over conventional skin packages. These include:

1. The plastic film used as the base film is less expensive than permeable card stock conventionally employed. It especially has economic advantages over coated and perforated card stock commonly used in making skin packages;
2. Any good-quality polyethylene film, or similar plastic material, can be employed. Specially-treated films are not required for this package. Thus, the plastic film used for both the base and the covering of the package is less expensive than the base and the film used in conventional packages; and,
3. Inventory requirements are reduced since the same material is used for both the base and the covering sheets.

As previously suggested, the package has a number of advantages over prior packages. One advantage is achieved when the base film is used in its simplest form; that is, the described form where the film is simply formed by using the platen of a conventional skin packaging machine. This one advantage is that the projecting dimples on the base sheet tend to retain circular and spherical products in place. That is, the dimples inhibit rolling when circular products are positioned on the base sheet for packaging.

Another advantage of all forms of the invention is that, unlike card stock, the flexible base sheet conforms to the platen before pressure is applied. Thus, the base sheet does not tend to be drawn out of shape when the vacuum system is placed in operation.

In many applications, it is desirable that the base sheet not be dimpled across its entire surface. For example, if one wishes to be able to see the part clearly from either side of the package, it may be desirable to have a flat, non-dimpled area in the base sheet. This is conveniently accomplished by placing flat inserts at various locations on the platen before the base sheet is formed. When heat-softened film is forced down against the platen, a small pocket is formed at each insert location. Preferably, these flat metal inserts will be magnetic so that they will remain where positioned on the platen and a series of identical base sheets can be formed.

If metal inserts are made to the contour of parts to be packaged, the formation of a base sheet for such applications as a kit for repair parts is greatly facilitated. The person placing the parts on the base sheet before the package is formed can make sure that a part of the contour of each formed pocket is placed in each pocket. Thus, formation of a complete kit and inspection to be sure that a given kit is complete, is greatly facilitated.

If an insert, such as a thin metal sheet having evenly spaced holes, for example about ½ inch in diameter, is used other advantages can be achieved. When a base sheet is formed over such an insert, it will have a series of circular dimpled areas of ½ inch diameter. These provide selective areas of cover film to base sheet adherence and also provide cushioning over a part for protection of the part. Obviously, an insert with spaced ½ inch holes is only by way of example. Such an insert between a base sheet and the platen can take any of many varied forms.

Another advantage of the present invention is that multiple-layered skin packages can be formed. After a first product has been skin packaged in place, one may simply place a second product on top of the first and then apply another layer of film. This second layer of covering film will adhere to the first, because the first has taken on a dimpled contour of the base sheet in that area where they are bonded together.

Another manner of making multiple parts packages is to use a small base sheet and package a first part with a covering film that extends beyond the small base sheet. The covering film is then trimmed to dimensions slightly larger than the base sheet and the package inverted for packaging of a second part.

The band of film from the first package projecting beyond the base sheet becomes a base sheet for a second covering film once the package is inverted. This can be repeated any number of times, with the package becoming slightly larger in width and height as well as thickness each time a part is added.

In another form of the invention, if the insert extends to an edge of the base sheet, and in fact is again used on top of the base sheet after it has been formed and inverted, the base sheet and film can be adhered together around three edges. This leaves the fourth edge open to provide an inexpensive, but functional envelope.

Another advantage of skin packages made in accordance with this invention is the finished package is quite flexible. Accordingly, a package containing a number of parts can be rolled and, for example, inserted in a mailing tube for shipment or storage.

The same technique and equipment can be used to form blister packages. One simply places inserts on the platen to the shape of the blisters which are to be formed and then thermoforms plastic sheet material, as distinguished from film, onto the platen. The formed blisters can be easily closed with a skin packaging technique or by bonding a suitable closure to them.

Other objects and a fuller understanding of the invention may be had by referring to the following description and claims taken in conjunction with the accompanying drawings.

DESCRIPTION OF THE PREFERRED EMBODIMENT

Figure 1:
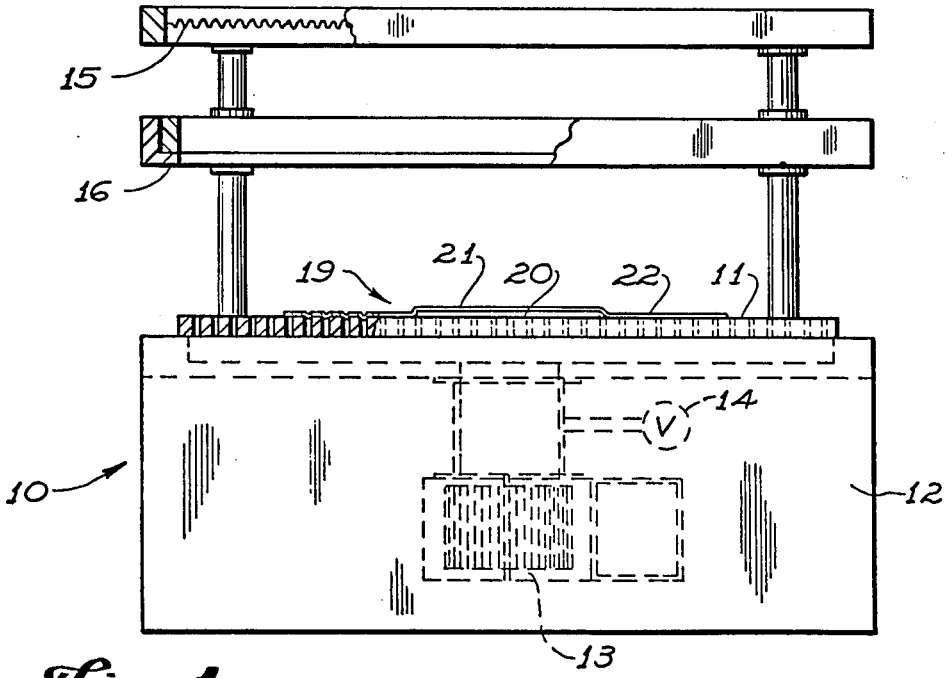
FIG. 1 is a schematic view of a skin packaging machine with a base sheet positioned to be formed.
Figure 2:
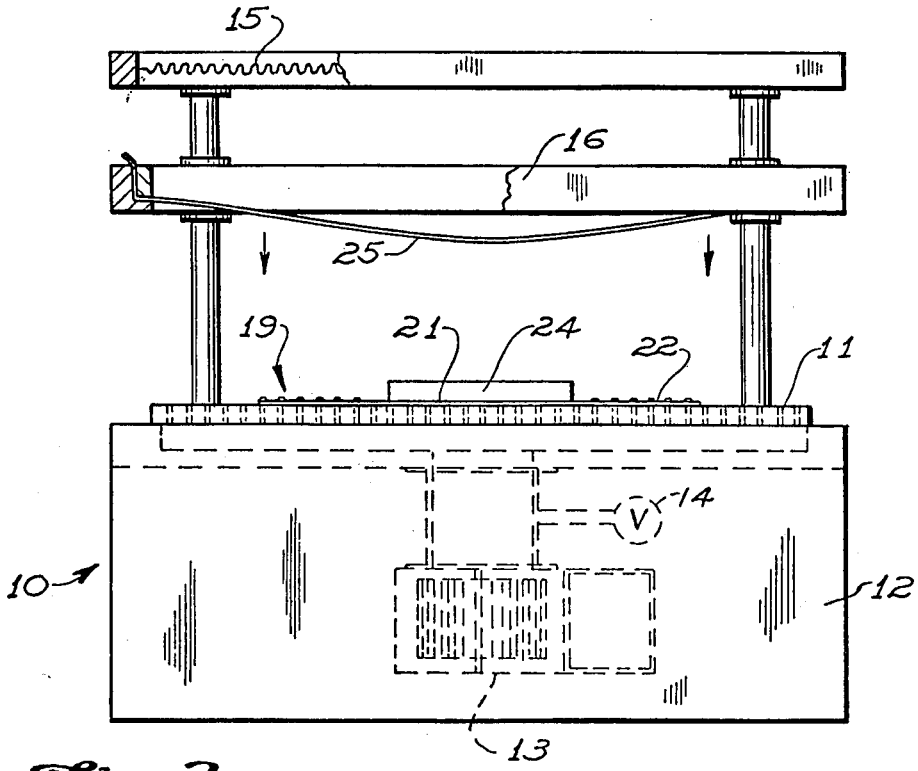
FIG. 2 is a similar schematic view of a skin packaging machine showing a formed base sheet positioned for forming a package, a product in place, and a covering film held by a drape frame.

Referring to the drawings and to FIGS. 1 and 2 in particular, a skin packaging machine is shown schematically at 10. Since the skin packaging machine itself is conventional, it is shown only schematically. A suitable, commercially-available skin packaging machine for performing the process and making the package of this invention is a Model 200 series vacuum packaging machine sold under the trademarks AMPAK and PORT-A-VAC by American Packaging Corporation of Hudson, Ohio.

The packaging machine 10 includes a platen 11. The platen 11 typically is a perforated sheet of steel having uniformly disposed perforations. Typically, the perforations may be of the order of 1/32 inch in diameter and they will be spaced of the order of ⅛ inch from center to center. There will be of the order of 75 holes per square inch.

The machine 10 includes a vacuum chamber 12 below the platen 11. The vacuum chamber 12 is evacuated by a suitable vacuum source such as a vacuum pump 13. An oven is above the platen 11 and is represented by a schematic showing at 15 of a heater element.

The commercial machine is slightly modified in that a bleed line and bleed valve 14 are provided. The valve is adjusted to draw air through the line as well as through the platen 11 when it is desired to reduce the platen vacuum.

A drape frame is shown at 16. The drape frame holds a covering film adjacent the heater 15 until the film is heat softened. The drape frame is then lowered to position the film for formation of a package.

Referring now to FIG. 1, a sheet of plastic film to be formed into a base sheet is shown at 19. An insert 20 is mounted on the platen so that an area 21 will be free of dimples in the finished base sheet 19. As has been suggested previously, in its simplest form, the insert 20 is not employed. Conversely, where desired, a series of inserts 20 may be used but for clarity of illustration, only one is shown in FIG. 1. Similarly, for clarity of illustration, the thickness of the insert 20 and of the plastic film 19 is greatly exaggerated in the drawings.

When the base sheet is formed, the drape frame need not contain a film. The oven, represented by the heater 15, is energized to thermosoften the base film 19. The vacuum pump 13 is then operated to draw the film tightly down against the insert 20 and the platen 11. A smooth pocket is formed over the insert 21. The vacuum draws portions of the film 19 in a dimpled area 22 into the holes in the platen. The vacuum preferably is not sufficiently high to cause the film to rupture as it is forced into the platen apertures. For this purpose, the vacuum may be adjusted by adjusting the bleed valve 14.

When film in the dimpled area 22 is drawn against the platen, a series of projections or dimples are formed by the portions drawn into the platen perforations. The spaces between these dimples or projections are smooth surfaces where the film has been drawn against the platen. These smooth surfaces form recesses between the projections.

After the base sheet has been formed in the manner shown and described in connection with FIG. 1, it is stripped from the platen and inverted so that the projections extend upwardly as depicted in FIG. 2. A body 24, which may be a part or other object such as a washer, is positioned on the pocket 21 of the inverted base sheet 19.

A covering film 25 is positioned in the drape frame and adjacent the heater 15 for thermosoftening. After the covering film 25 has been thermosoftened, the drape frame 16 is lowered to a position near the platen 11. The vacuum pump 13 is then operated to establish a pressure differential. Since the base film 19 is imperforate, the vacuum pump 13 serves to establish a volume of reduced pressure between the base film 19 and the covering film 25 by withdrawing air from around the perimeter of the base film 19.

It should also be noted that many plastic films are not truly imperforate. Moreover, the small projections may rupture when burned but the holes thus formed are small and do not adversely affect the formation of the novel package. As used here, the term "imperforate" as applied to the substrate or base sheet 19, is intended to mean sufficiently imperforate to a flow of air at the pressure differentials which are established in skin packaging when a vacuum system is operating so that the package is formed primarily by withdrawing air from around the perimeter of the base sheet rather than through it.

Establishment of the described volume of reduced pressure between the base and covering films 19, 25 establishes a pressure differential on the covering film 25. This forces the heat softened covering film 25 down over the body 24 and against the base film 19. As the covering film 25 approaches the base film, entrapped air moves radially outwardly from the center of the package in all directions. This establishes a flow of air around the projections and through the recesses defined by the projections in the base film 19. This flow of air apparently keeps the two films apart until the air is exhausted adequately, and the paths or channels through which evacuation is accomplished then necessarily progressively collapse, to achieve a tight physical contact and a mechanical bond in the dimpled area 22.

By appropriate selection of films and temperature control, the mechanical bond can be enhanced by a physical bonding to produce a hermetically sealed package. If the bond is only mechanical, obviously the package is readily openable by simply separating the films near the perimeter and pulling. With a physical bond caused by heat softening and forcing the two films together, complete hermetic protection is obtainable.

Figure 4:
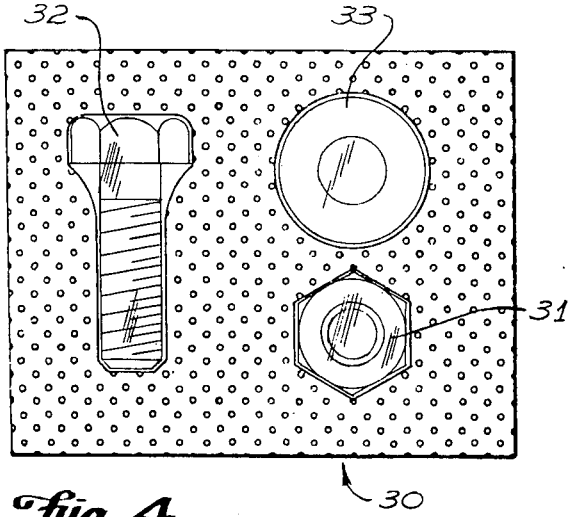
FIG. 4 is a plan view of a package.
Figure 7:
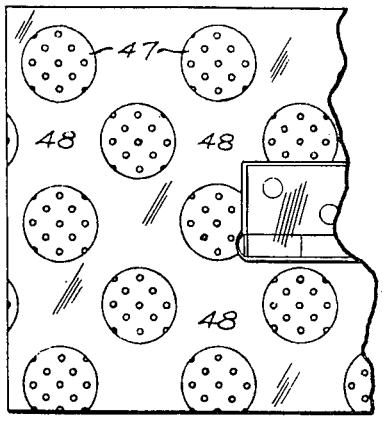

As an example of how to obtain a bond which is primarily, if not exclusively, only mechanical, it has been found that one may use polyethylene film of 4 to 10 mils thickness for both the base and covering film or sheets. As shown in FIGS. 4 and 7, the sheets are typically light transparent. When the package is formed, the temperature and length of time vacuum is applied is relatively short.

Where a physical bond as well as a mechanical bond is used, it has been found that a simple elevation in covering film temperature of a few degrees and maintaining vacuum for longer times will accomplish the desired result.

The temperatures and vacuum time durations vary according to films being used. One simply increases the heat and vacuum cycles if a mechanical bond is being obtained and a physical bond is desired and vice versa.

Figure 3:
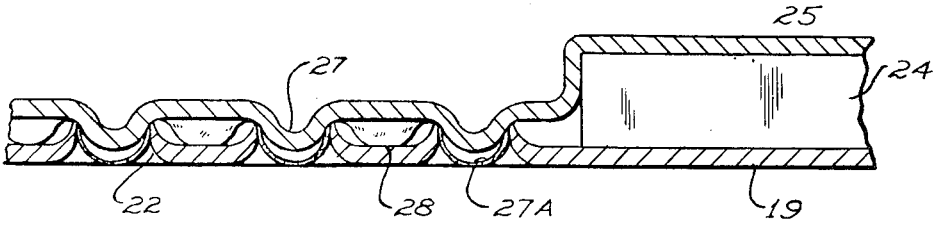
FIG. 3 is an enlarged fragmentary sectional view of the finished package.

Referring now to FIG. 3, an enlarged fragmentary sectional view is shown of a package. There the plastic thickness is greatly exaggerated for clarity. An examination of FIG. 3 will show that after package formation, a dimple top 27A has become concave and the covering film 24 has been drawn down snugly over the product and, in addition, into tight intimate physical contact with and into the dimples 27. The cover sheet remains spaced from the recesses 28 between the dimples.

In FIG. 4, a sample parts kit package has been shown at 30. For simplicity of illustration, the parts kit has been shown as a nut and bolt 31, 32 and a washer 33. A hex-shaped insert was used to provide a pocket for the nut 31, a T-shaped insert for the bolt 32, and a circular insert for the washer 33.

It can be seen that the balance of the package around each of these three parts is dimpled and the covering film has been brought into tight contact and connection with the base sheet.

Figure 5:
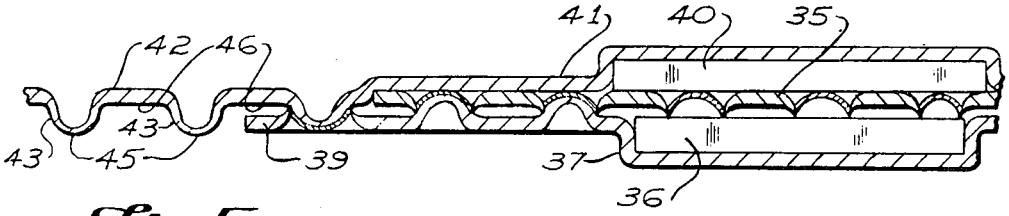
FIG. 5 is an enlarged fragmentary sectional view of one form of multiple parts package where the parts are packaged sequentially rather than simultaneously.

In FIG. 5, a base sheet 35 was first formed. A product 36 was then packaged to the base sheet by a first covering sheet 37. The first covering sheet 37 extends perimetrally outwardly from the base sheet 35 and dimples have been formed in a perimetral portion 39. The package was then inverted and this perimetral portion 39 became the base sheet for a second part 40 and a second covering sheet 41. The second covering sheet 41 includes a perimetral part 42 which may serve as the base sheet for a third part if that is desired. Thus, one may simply invert the package of FIG. 5, place yet another part on top of the first base sheet 37 and form a package by drawing another covering sheet, this time into engagement with the perimetral base part 42.

The projections in the perimetral base part 42 are dome shaped. That is, each projection includes a frustoconical side wall 43 and a convex top 45. By contrast, the tops of other projections in the drawings are accurately shown as concave. The reason is that the initially concave projections become convex at the time when pressure is applied to connect a cover sheet to a base sheet.

It will also be seen that the walls of the projections 42 taper from a relatively thick base adjacent recesses 46 to the apex of the top 45.

Figure 6:
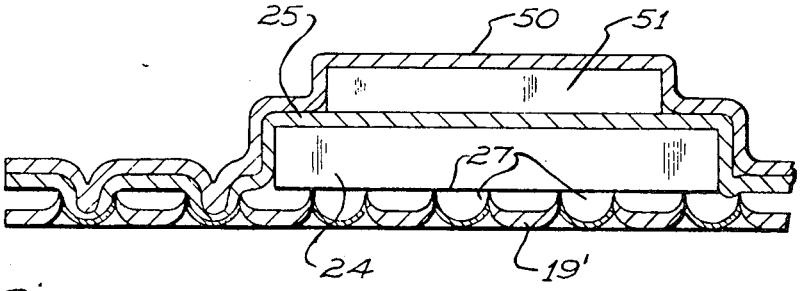
FIG. 6 is an enlarged, fragmentary view of another form of package with multiple parts that have been sequentially packaged; and, FIG. 7 is a fragmentary plan view of a package in which projections have been formed in spaced selected areas.

In FIG. 6 a second covering sheet 50 secures a second part 51 to a package like the package of FIG. 3 but for a small difference in the base sheet 19'. The difference is that no insert was used in forming the base sheet 19' and the projections are under the object 24. The projections are shown without tops as may occur in their formation. The package of FIG. 6 was formed simply by positioning the second product 51 on the package of FIG. 3 while it is on the platen 11 and then establishing a pressure differential to draw the thermosoftened second cover sheet 50 into place.

In FIG. 7, the projections are arranged in groups 47. The groups 47 are surrounded by flat areas 48. The covering sheet is drawn into tight intimate contact with the flat areas 48 of the base sheet.

Although the invention has been described in its preferred form with a certain degree of particularity, it is understood that the present disclosure of the preferred form has been made by way of example and that numerous changes in the details of construction and the combination and arrangement of parts may be resorted to without departing from the spirit and the scope of the invention as hereinafter claimed.

What is claimed is:

1. The process of forming a skin package with a skin packaging machine comprising the steps of:
(a) positioning a plastic film on the platen of a skin packaging machine;
(b) heat softening the film;
(c) first positioning inserts on the platen and then applying a pressure differential to the film to force portions of the film into apertures in the platen thereby forming projections on the film only in selected areas;
(d) inverting the film and positioning the film as a base sheet on a skin packaging machine platen;
(e) positioning a product on the base sheet and then forcing a heat softened plastic covering film into engagement with the base sheet by establishing a pressure differential on the covering film.

2. The process of claim 1 wherein the inserts are held in place by magnetism.

3. The process of claim 1 wherein the inserts are shaped to the contours of products to be packaged.

4. The process of forming a skin package with a skin packaging machine comprising the steps of:
(a) positioning a plastic film on the platen of a skin packaging machine;
(b) heat softening the film;
(c) applying a pressure differential to the film to force portions of the film into apertures in the platen thereby forming projections on the film;
(d) inverting the film and positioning the film as a base sheet on a skin packaging machine platen;
(e) positioning a product on the base sheet and then forcing a heat softened plastic covering film into engagement with the base sheet by establishing a pressure differential on the covering film; and
(f) positioning a second product on the covering film and heat softening a second covering film and forcing it into engagement with the first covering film by the establishment of a pressure differential.

5. The process of forming a skin package with a skin packaging machine comprising the steps of:
(a) positioning a plastic film on the platen of a skin packaging machine;
(b) heat softening the film;
(c) applying a pressure differential to the film to force portions of the film into apertures in the platen thereby forming projections on the film;
(d) inverting the film and positioning the film as a base sheet on a skin packaging machine platen;
(e) positioning a product on the base sheet and then forcing a heat softened plastic covering film into engagement with the base sheet by establishing a pressure differential on the covering film;
(f) said covering film being formed with a perimetral portion surrounding the base sheet, and bringing the perimetral portion into engagement with the platen to form projections thereon,
(g) inverting the package;
(h) positioning a second product on the inverted package;
(i) heat-softening a second covering film and then forcing the film by a pressure differential into engagement with the package and adhering it to said perimetral portion.

6. The process of forming a skin package with a skin packaging machine comprising the steps of:
(a) providing a skin packaging machine with a platen perforated with uniformly disposed circular apertures;
(b) positioning a plastic film on the platen;
(c) heat-softening the film;
(d) forming a plurality of uniformly spaced dome-shaped projections separated by flat sheet areas by applying a pressure differential to the film to force portions of the film into the circular apertures in the platen;
(e) inverting the film and positioning the film as a base sheet on a skin packaging machine platen;
(f) positioning a product on the base sheet;
(g) heating both a covering film and the base sheet;
(h) bringing the covering sheet into engagement with the base sheet while withdrawing air from between the sheet and film at the perimeter of the base sheet and forming concave ends in the projections to establish a bond between the sheet and film that is at least in part mechanical.

7. In a method of packaging an object in a vacuum skin pack formed by evacuating space between a pair of sheets containing said object and sealing said sheets to each other about said object, the improvement comprising in combination the steps of:
providing a pair of sealable sheets, each being imperforate at least at the sealing surface and at the location of the object;
forming a multitude of convex protrusions in a regular pattern in at least one of said sheets for providing during the formation of said pack a multitude of collapsible and sealable evacuation channels extending between said sheets from space adjacent said object to the periphery of at least said one sheet and being delimited on opposite sides by said sheets;
providing said object between said sheets and said sheets in proximity to each other to form said evacuation channels;
evacuating the space around said object and between said sheets through said evacuation channels that have been formed from space adjacent said object to the periphery of at least said one sheet; and
continuing said evacuation essentially only through said evacuation channels while said sheets maintain said evacuation channels delimited and form gas barriers on said opposite sides to progressively collapse said evacuation channels and to seal said collapsed evacuation channels by sealing said sheets to one another throughout the contacting surfaces of said sheets.

8. A method as claimed in claim 7, wherein:
said evacuation channels are provided by forming said protrusions in one of said sheets in a regular pattern and placing peripheral portions of the other of said sheets on top portions of said protrusions.

9. A method as claimed in claim 7, wherein:
both of said sheets are made of light transparent material.

10. A method as claimed in claim 7, wherein:

the sealing of said sheets to each other about said object is retarded by said protrusions during the evacuation of said space.

11. A method as claimed in claim 7, wherein:

at least one of said sheets is thermoplastic and is softened by heat at least during said evacuation.

12. A method as claimed in claim 7, wherein:

said protrusions are provided by forming a multitude of convex raised nodes in a regular pattern in at least one of said sheets, said nodes being spaced from each other to provide said evacuation channels.

13. A method as claimed in claim 12, wherein:

said raised nodes are offset relative to each other to contort said evacuation channels.

14. An article of manufacture made by a method as claimed in claim 7.

15. An article of manufacture made by a method as claimed in claim 13.

16. An article of manufacture as claimed in claim 14, wherein:

both of said sheets are light-transparent.

17. In a method of packaging an object in a vacuum skin pack formed by evacuating space between a pair of sheets containing said object and sealing said sheets to each other about said object, the improvement comprising in combination the steps of:

providing a pair of sealable sheets, each being imperforate at least at the sealing surface and at the location of the object;

forming a multitude of convex protrusions in a regular pattern in and throughout one of said sheets for providing during the formation of said pack a multitude of collapsible and sealable evacuation channels extending between said sheets from space adjacent said object to the periphery of at least said one sheet and being delimited on opposite sides by said sheets;

placing said one sheet on a support in evacuating equipment with said protrusions extending in a direction away from said support;

placing said object on said one sheet;

placing the other of said sheets on said object and in proximity to said one sheet to form said evacuation channels;

evacuating the space around said object and between said sheets through said evacuation channels that have been formed from space adjacent said object to the periphery of said one sheet; and continuing said evacuation essentially only through said evacuation channels while said sheets maintain said evacuation channels delimited and form gas barriers on said opposite sides, to draw said other sheet into intimate conformity with adjacent portions, including lateral portions, of said object and to progressively collapse said evacuation channels and to seal said collapsed evacuation channels by heat sealing said sheets to one another throughout the contacting surfaces of said sheets.

18. A method as claimed in claim 17, wherein:

the sealing of said sheets to each other about said object is retarded by said protrusions to during the evacuation of said space.

19. A method as claimed in claim 17, wherein:

said sheets are thermoplastic and are softened by heat.

20. A method as claimed in claim 17, wherein:

said protrusions are provided by forming a multitude of convex raised nodes in a regular pattern in said one sheet.

21. A method as claimed in claim 20, wherein:

said raised nodes are offset relative to each other to contort said evacuation channels.

22. An article of manufacture made by a method as claimed in claim 17.

23. An article of manufacture made by a method as claimed in claim 21.

* * * * *